US011740571B2

(12) United States Patent
Nakazato

(10) Patent No.: US 11,740,571 B2
(45) Date of Patent: Aug. 29, 2023

(54) IMAGE FORMING APPARATUS

(71) Applicant: CANON KABUSHIKI KAISHA, Tokyo (JP)

(72) Inventor: Jun Nakazato, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/189,778

(22) Filed: Mar. 2, 2021

(65) Prior Publication Data

US 2021/0271186 A1 Sep. 2, 2021

(30) Foreign Application Priority Data

Mar. 2, 2020 (JP) ..... 2020-035061

(51) Int. Cl.
*G03G 15/08* (2006.01)

(52) U.S. Cl.
CPC ..... *G03G 15/0849* (2013.01)

(58) Field of Classification Search
CPC ..... G03G 15/0856; G03G 15/0891; G03G 15/0849; G03G 15/086; G03G 15/0853; G03G 15/0893; G03G 15/556; G03G 15/0877
See application file for complete search history.

(56) References Cited

U.S. PATENT DOCUMENTS

2010/0202794 A1* 8/2010 Kosaka ..... G03G 15/0409 399/88
2013/0272734 A1* 10/2013 Zollner ..... G03G 15/0851 399/57
2016/0291508 A1* 10/2016 Mashiki ..... G03G 15/0851

FOREIGN PATENT DOCUMENTS

JP 08-271481 A 10/1996

* cited by examiner

*Primary Examiner* — Jessica L Eley
(74) *Attorney, Agent, or Firm* — Canon U.S.A., Inc. IP Division

(57) ABSTRACT

An image forming apparatus including a developing unit with a developing container configured to contain a developer including a toner and a carrier, and configured to develop the electrostatic latent image by using the developer in the developing container. A sensor, which is provided on an outer wall of the developing container, is configured to output a pulse signal that changes in frequency depending on a toner concentration of the developer in the developing container. A controller is provided to control supply of the toner to the developing unit by detecting the toner concentration based on the time required for the pulse number to reach a predetermined count number.

4 Claims, 8 Drawing Sheets

IMAGE FORMING APPARATUS

BACKGROUND OF THE DISCLOSURE

Field of the Disclosure

The present disclosure generally relates to an image forming apparatus which includes a developing device configured to contain a developer including a toner and a magnetic material, and, more specifically, is capable of detecting a toner concentration of the developer contained in the developing device with a magnetic sensor.

Description of the Related Art

Hitherto, as a concentration measurement unit configured to measure a toner concentration of a two-component developer made of a mixture of a magnetic carrier and a toner, there has been used a magnetic sensor formed of an LC resonant circuit including a detection coil. An operation principle of the magnetic sensor is as follows: when a mixing ratio between the magnetic carrier and the toner in a detection area is changed, a magnetic permeability is changed to change an inductance L, and consequently, an output frequency of the LC resonant circuit is changed. In recent years, as in Japanese Patent Application Laid-Open No. H08-271481, in an increasing number of magnetic sensors, a detection coil portion is formed of a circuit wiring pattern on a circuit board to reduce cost. In such a magnetic sensor, the detection coil portion is formed in the same plane as the circuit board, and it is difficult for the detection coil portion to penetrate to the inside of a developer container. Therefore, the magnetic sensor is attached in close contact with an outer wall of the developer container to indirectly detect the toner concentration of the developer with the magnetic sensor from outside the container.

However, the developer is detected indirectly from outside the container as described above, and thus a distance from the magnetic sensor to the developer inside the container may be changed because of a thickness tolerance of the container. FIG. 5 is a graph for showing a distance characteristic of the magnetic sensor. In FIG. 5, the horizontal axis indicates a container thickness (mm). The vertical axis indicates an output frequency ratio with reference to an output frequency at a container thickness of 0 mm. As can be seen from FIG. 5, the output frequency of the magnetic sensor changes exponentially with respect to the container thickness. Therefore, output sensitivity of the magnetic sensor with respect to a change in toner concentration of the developer also changes in accordance with the container thickness.

A variation in container thickness is predominantly caused in manufacturing. Therefore, a developer concentration detection characteristic of the magnetic sensor is different for each developing device. Referring to FIG. 6, a change in concentration detection characteristic caused by the variation in container thickness is described. FIG. 6 is a graph for showing developer concentration detection characteristics for three developing devices having different container thicknesses. The horizontal axis indicates a toner concentration expressed by the mixing ratio between the toner and the magnetic carrier. The vertical axis indicates a measured value expressed by a count value obtained by measuring the output frequency of the magnetic sensor as time by a digital clock. In developer toner concentration control, a change from a toner concentration of 8% at the time of shipping as a reference is measured for feedback control of a toner supply amount. Therefore, as shown in FIG. 6, when the sensitivity characteristic with respect to the toner concentration is different, a different measured value is measured for the change in toner concentration for each developing device. As a developing device has a larger deviation from a pre-programmed reference characteristic (reference characteristic of a container thickness of 2.0 mm having medium sensitivity) indicating a relationship between the toner concentration and the measured value, a deviation from optimal toner supply control becomes larger, and the toner concentration deviates further from a target.

When the toner concentration varies among yellow, magenta, cyan, and black stations, a hue variation caused when colors are superimposed also increases. Naturally, an individual product difference may also increase.

SUMMARY OF THE DISCLOSURE

According to an embodiment of the present disclosure, there is provided an image forming apparatus comprising: a photosensitive member; a charging unit configured to charge the photosensitive member; an exposure unit configured to expose the photosensitive member charged by the charging unit to form an electrostatic latent image on the photosensitive member; a developing unit which includes a developing container configured to contain a developer including a toner and a carrier, and is configured to develop the electrostatic latent image by using the developer in the developing container; a sensor which is provided on an outer wall of the developing container, and is configured to output a pulse signal that changes in frequency depending on a toner concentration of the developer in the developing container; and a controller configured to count a pulse number of the pulse signal output by the sensor, detect the toner concentration based on time required for the pulse number to reach a predetermined count number, and execute supply control of supplying the toner to the developing unit based on the toner concentration.

Further features of the present disclosure will become apparent from the following description of exemplary embodiments with reference to the attached drawings.

DESCRIPTION OF THE EMBODIMENTS (Image Forming Apparatus)

Figure 4:
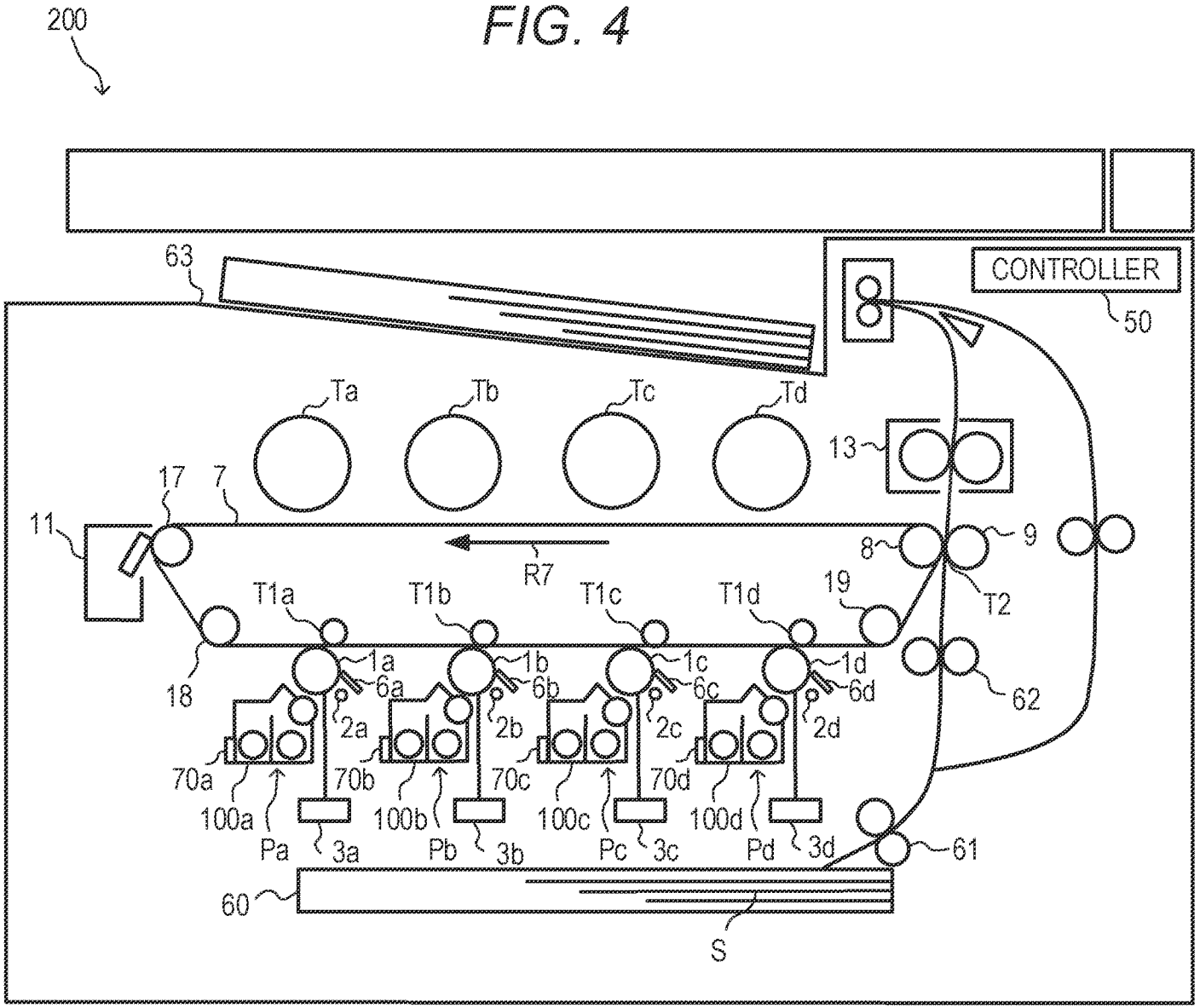
FIG. 4 is a cross-sectional view of an image forming apparatus.
Figure 5:
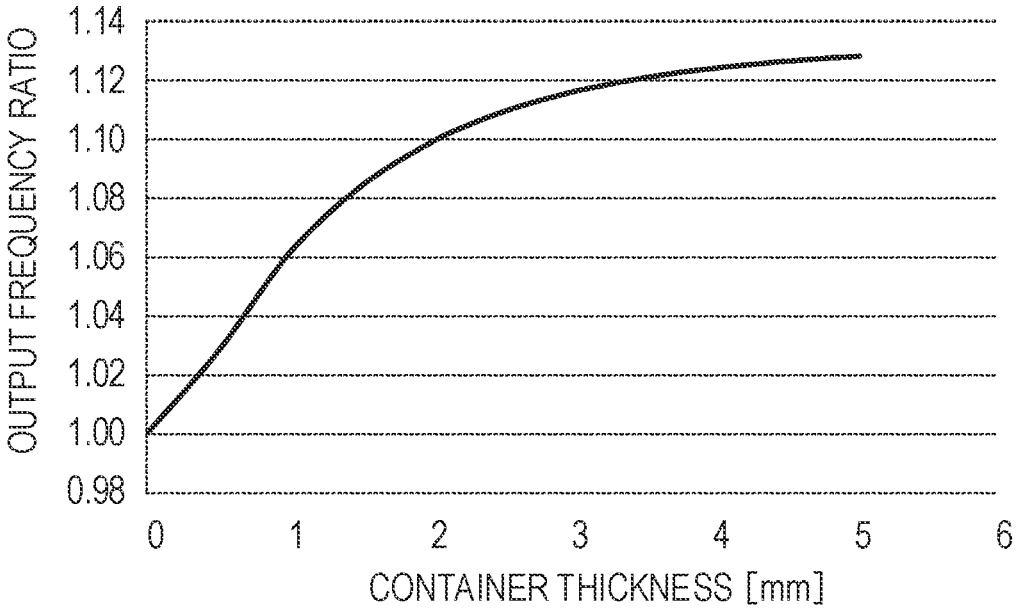
FIG. 5 is a graph for showing a distance characteristic of a magnetic sensor.

FIG. 4 is a cross-sectional view of an image forming apparatus 200. The image forming apparatus 200 is configured to form a color image on a recording medium (hereinafter referred to as "sheet") S by an electrophotographic method. However, the image forming apparatus 200 is not limited thereto, and may be a printer, a copying machine, a multifunction peripheral, or a facsimile machine. The image forming apparatus 200 adopts an intermediate transfer tandem system in which four image forming portions Pa, Pb, Pc, and Pd configured to form images with toners having respective color components are arrayed along a conveying direction R7 of an intermediate transfer belt (intermediate transfer member) 7.

The sheet S on which an image is to be formed is housed in a feed cassette 60. The sheet S is fed from the feed cassette 60 by feed rollers 61 adopting a friction separating system in accordance with a timing of image formation by the image forming portions Pa to Pd. The feed rollers 61 are configured to convey the sheet S to registration rollers 62 through a conveyance path. The registration rollers 62 are configured to correct skew of the sheet S and adjust a timing to convey the sheet S to a secondary transfer portion T2.

The image forming portions Pa, Pb, Pc, and Pd include photosensitive members 1*a*, 1*b*, 1*c*, and 1*d*, charging devices 2*a*, 2*b*, 2*c*, and 2*d*, exposure devices 3*a*, 3*b*, 3*c*, and 3*d*, and developing devices 100*a*, 100*b*, 100*c*, and 100*d*, respectively. The image forming portions Pa, Pb, Pc, and Pd further include primary transfer portions T1*a*, T1*b*, T1*c*, and T1*d* and photosensitive member cleaners 6*a*, 6*b*, 6*c*, and 6*d*, respectively. The photosensitive members 1*a*, 1*b*, 1*c*, and 1*d* are rotated. The charging devices 2*a*, 2*b*, 2*c*, and 2*d* serving as charging units are configured to uniformly charge surfaces of the photosensitive members 1*a*, 1*b*, 1*c*, and 1*d*, respectively. The exposure devices 3*a*, 3*b*, 3*c*, and 3*d* serving as exposure units are configured to irradiate the uniformly charged surfaces of the photosensitive members 1*a*, 1*b*, 1*c*, and 1*d*, respectively, with light modulated in accordance with image data of respective colors to expose the surfaces. As a result, electrostatic latent images are formed on the surfaces of the photosensitive members 1*a*, 1*b*, 1*c*, and 1*d* in accordance with the image data.

The developing devices 100*a*, 100*b*, 100*c*, and 100*d* serving as developing units are removably mounted in the image forming apparatus 200. The developing devices 100*a*, 100*b*, 100*c*, and 100*d* are configured to contain two-component developers each obtained by mixing a non-magnetic toner and a magnetic carrier (magnetic material). The developing devices 100*a*, 100*b*, 100*c*, and 100*d* are configured to develop the electrostatic latent images formed on the surfaces of the photosensitive members 1*a*, 1*b*, 1*c*, and 1*d*, respectively, with the toners of respective colors. The developing devices 100*a*, 100*b*, 100*c*, and 100*d* are configured to apply the toners to the electrostatic latent images formed on the surfaces of the photosensitive members 1*a*, 1*b*, 1*c*, and 1*d*, respectively, to develop the electrostatic latent images and form toner images. The image forming portion Pa is configured to form a yellow toner image. The image forming portion Pb is configured to form a magenta toner image. The image forming portion Pc is configured to form a cyan toner image. The image forming portion Pd is configured to form a black toner image. It should be noted, however, that the number of colors of the toner images to be formed is not limited to four. For example, five image forming portions may be provided to develop the toner images with toners of five colors.

The primary transfer portions T1*a*, T1*b*, T1*c*, and T1*d* serving as primary transfer units are configured to have a predetermined pressurizing amount and electrostatic load bias applied thereto to transfer the toner images from the photosensitive members 1*a*, 1*b*, 1*c*, and 1*d* to the intermediate transfer belt 7, respectively. Onto the intermediate transfer belt 7, the yellow, magenta, cyan, and black toner images are transferred in a superimposed manner to form a full-color toner image. The toners remaining on the photosensitive members 1*a*, 1*b*, 1*c*, and 1*d* after the transfer are collected by the photosensitive member cleaners 6*a*, 6*b*, 6*c*, and 6*d*, respectively.

To the developing devices 100*a*, 100*b*, 100*c*, and 100*d*, toner concentration sensors 70*a*, 70*b*, 70*c*, and 70*d* configured to detect toner concentrations of the developers contained in the developing devices 100*a*, 100*b*, 100*c*, and 100*d* are attached, respectively. A toner concentration is a weight ratio of the toner with respect to the developer (toner+magnetic carrier) contained in each of the developing devices 100*a*, 100*b*, 100*c*, and 100*d*. The toner concentration sensors 70*a*, 70*b*, 70*c*, and 70*d* are magnetic sensors configured to generate magnetic fields to detect changes in magnetic field. An output of each of the toner concentration sensors 70*a*, 70*b*, 70*c*, and 70*d* is changed in accordance with a mixing ratio between the non-magnetic toner and the magnetic carrier of the two-component developer contained in a corresponding one of the developing devices 100*a*, 100*b*, 100*c*, and 100*d*. Based on the outputs of the toner concentration sensors 70*a*, 70*b*, 70*c*, and 70*d*, toner amounts in the developing devices 100*a*, 100*b*, 100*c*, and 100*d* are determined.

Toner bottles Ta, Tb, Tc, and Td are removably mounted in the image forming apparatus 200. The toner bottles Ta, Tb, Tc, and Td function as containers configured to contain toners for replenishment. The toner bottle Ta is configured to contain a yellow toner. The toner bottle Tb is configured to contain a magenta toner. The toner bottle Tc is configured to contain a cyan toner. The toner bottle Td is configured to contain a black toner. In accordance with the toner concentrations detected by the toner concentration sensors 70*a*, 70*b*, 70*c*, and 70*d*, the toners are supplied from the toner bottles Ta, Tb, Tc, and Td serving as toner supply containers to the developing devices 100*a*, 100*b*, 100*c*, and 100*d*, respectively.

The intermediate transfer belt 7 is provided to an intermediate transfer belt frame (not shown). The intermediate transfer belt 7 is an endless belt tensioned by a secondary transfer inner roller 8, a driven roller 17, a first tension roller 18, and a second tension roller 19. The intermediate transfer belt 7 is rotated in the conveying direction R7. The intermediate transfer belt 7 is rotated in the conveying direction R7 to convey the full-color toner image transferred onto the intermediate transfer belt 7 to the secondary transfer portion T2.

The sheet S is conveyed at a timing to meet the toner image transferred onto the intermediate transfer belt 7 at the secondary transfer portion T2. The secondary transfer portion T2 is a transfer nip formed by the secondary transfer inner roller 8 and a secondary transfer outer roller 9 which are arranged to be opposed to each other. The secondary transfer portion T2 has a predetermined pressurizing force and electrostatic load bias applied thereto to attract the toner image on the sheet S. In this manner, the secondary transfer portion T2 serving as a secondary transfer unit is configured to transfer the toner image on the intermediate transfer belt 7 to the sheet S. The toners remaining on the intermediate transfer belt 7 after the transfer are collected by a transfer cleaner 11.

The sheet S having the toner image transferred thereto is conveyed from the secondary transfer portion T2 to a fixing device 13 by the secondary transfer outer roller 9. The fixing device 13 serving as a fixing unit is configured to apply a predetermined pressure and amount of heat to the sheet S by a fixing nip formed by opposing rollers to melt and fix the toner image on the sheet S. The fixing device 13 includes a heater configured to serve as a heat source, and is controlled so that an optimal temperature is always maintained. The sheet S having the toner image fixed thereon is discharged on a discharge tray 63. In a case of double-sided image formation, the sheet S is reversed by a reverse conveyance mechanism and is conveyed to the registration rollers 62.

(Toner Concentration Sensor)

Figure 1:
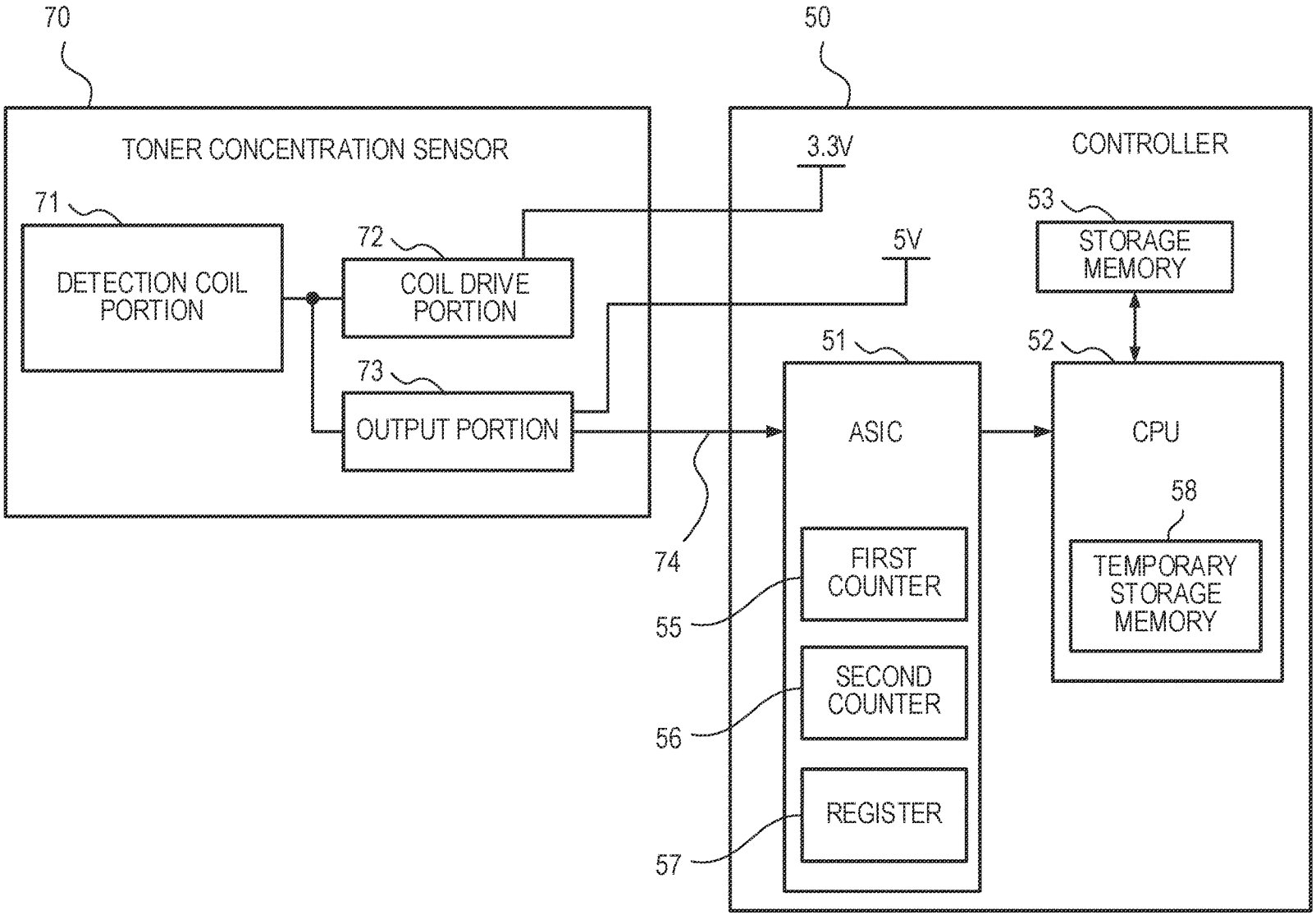
FIG. 1 is a block diagram of a toner concentration sensor and a controller.
Figure 2A:
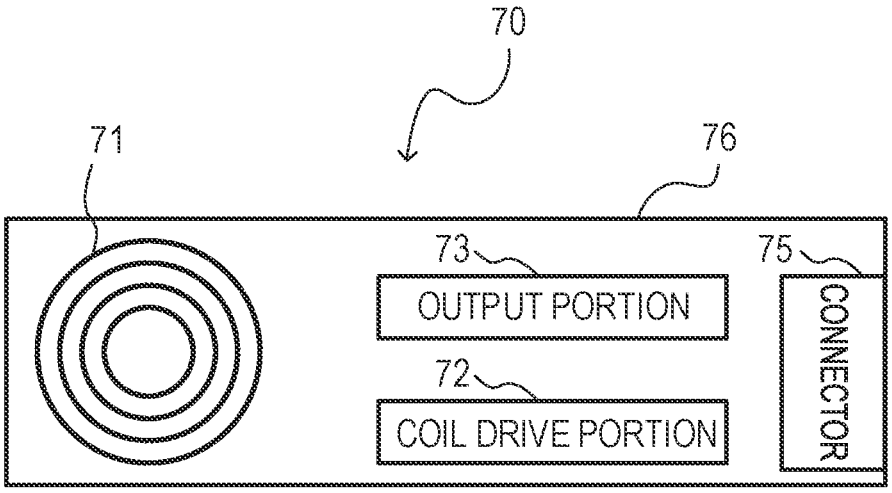
FIG. 2A and FIG. 2B are diagrams for illustrating the toner concentration sensor.
Figure 2B:
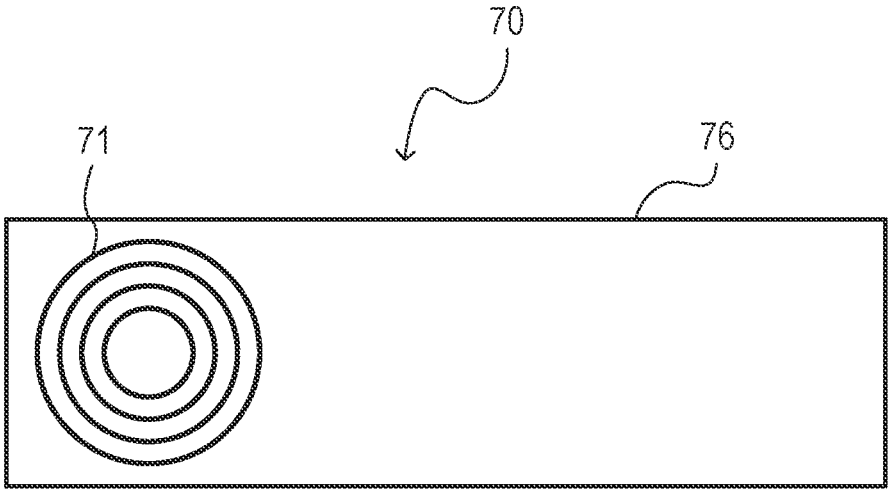

Next, referring to FIG. 2A and FIG. 2B, the toner concentration sensors 70*a*, 70*b*, 70*c*, and 70*d* are described. Suffixes "a," "b," "c," and "d" to reference numerals indicate yellow, magenta, cyan, and black, respectively. Components of the respective colors have similar structures, and hence the suffixes "a," "b," "c," and "d" to the reference numerals are omitted when no particular distinction is required. FIG. 2A is a diagram for illustrating a component side of the toner concentration sensor 70. FIG. 2B is a diagram for illustrating a solder side of the toner concentration sensor 70. The toner concentration sensor 70 includes an electric board 76 having provided thereon detection coil portions 71 configured to detect a change in magnetic permeability, a coil drive portion 72 configured to electrically drive the detection coil portions 71, an output portion 73 configured to generate an output pulse signal 74 (FIG. 1), and a connector 75.

The detection coil portions 71 are wiring patterns (coil patterns) formed on the electric board 76, and are configured to generate an inductance component. In this embodiment, the detection coil portions 71 are formed on both of the component side illustrated in FIG. 2A and the solder side illustrated in FIG. 2B. The detection coil portion 71 on the component side and the detection coil portion 71 on the solder side are continuous to electrically form one coil. However, the wiring pattern of the detection coil portions 71 is not limited to one coil as in this embodiment. The detection coil portions 71 may be formed as two electrically independent coils.

The coil drive portion 72 is formed of a circuit including a transistor and a capacitor. The coil drive portion 72 is an oscillation circuit configured to resonate by the inductance of the detection coil portions 71 and the capacitor. The output portion 73 is a pulse generation circuit including a comparator configured to convert an analog signal waveform oscillated by the coil drive portion 72 into a digital signal. The output portion 73 is configured to output a binarized pulse signal.

(Arrangement of Toner Concentration Sensor)

Figure 3:
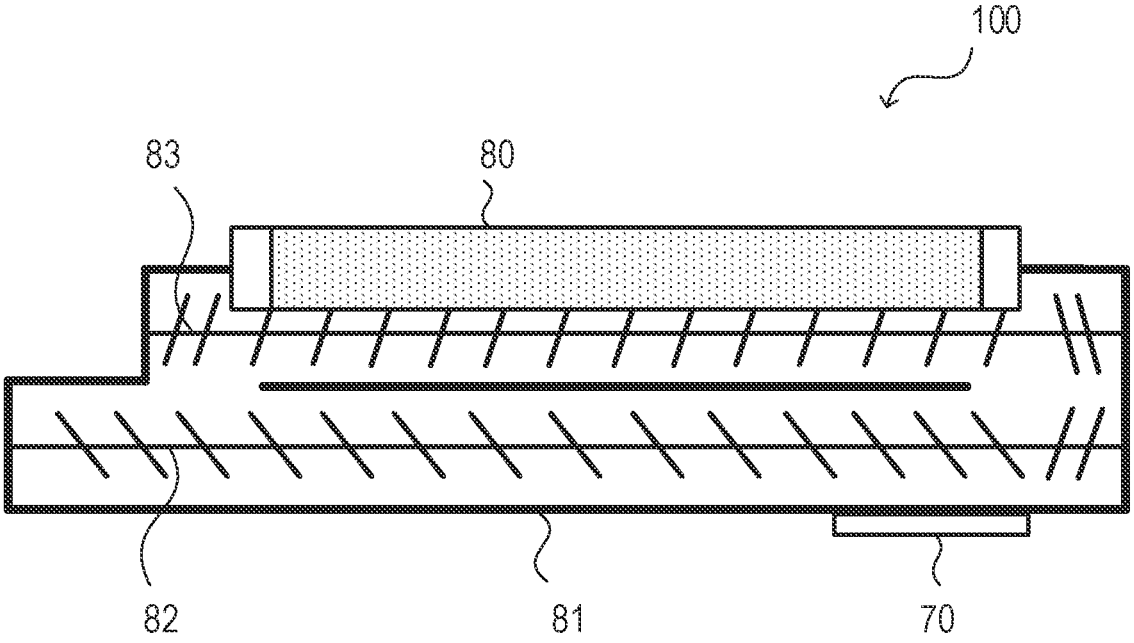
FIG. 3 is a view for illustrating a developing device having the toner concentration sensor attached thereto.

Next, referring to FIG. 3, arrangement of the toner concentration sensor 70 on the developing device 100 is described. FIG. 3 is a view for illustrating the developing device 100 on which the toner concentration sensor 70 is attached. The developing devices 100*a*, 100*b*, 100*c*, and 100*d* of respective colors have the same structure except for the colors of the toners contained therein. FIG. 3 shows a cross section of the developing device 100 as viewed from above. The developing device 100 includes a developer container 81 configured to contain a developer, agitation screws 82 and 83 serving as agitation members configured to agitate the developer in the developer container 81, and a developing roller 80 configured to bear the developer. The toner concentration sensor 70 is attached by thermal welding to be in close contact with an outer wall of the developer container 81 of the developing device 100. The developer container 81 is a container formed of a resin material. The outer wall of the developer container 81 has a thickness (hereinafter referred to as "container thickness") of about 2 mm. Therefore, the toner concentration sensor 70 is configured to detect a toner concentration in the developer container 81 under a state of no contact with the developer.

A toner is supplied from the toner bottle T to the developer container 81. The developer in the developer container 81 is circulated through the developer container 81 by the agitation screws 82 and 83 rotated by a drive portion (not shown). Through circulation of the developer, the supplied toner is mixed with a magnetic carrier put in the developer container 81 at the time of shipping. When the circulation is stopped, the magnetic carrier descends to the bottom of the developer container 81 because the magnetic carrier has a higher specific gravity than that of the toner. Therefore, in order to detect the toner concentration in the developer under a state in which the toner and the magnetic carrier are mixed as evenly as possible, the toner concentration is detected by the toner concentration sensor 70 while the agitation screws 82 and 83 are rotated.

(Controller)

Next, referring to FIG. 1, a controller 50 configured to control the toner concentration sensor 70 is described. FIG. 1 is a block diagram of the toner concentration sensor 70 and the controller 50. The toner concentration sensor 70 is electrically connected to the controller 50. The controller 50 is connected to the toner concentration sensor 70 by a power line for supplying a 3.3V power, a power line for supplying a 5V power, a signal line for transmitting the output pulse signal 74 being the output of the toner concentration sensor 70, and a GND line (not shown). When the 3.3V power and the 5V power are supplied to the toner concentration sensor 70, an LC resonant circuit formed of the detection coil portions 71 and the coil drive portion 72 operates to start an oscillation operation. Then, the output portion 73 formed of a comparator component outputs the binarized pulse signal.

The controller 50 includes an application specific integrated circuit (ASIC) 51, a CPU 52, and a storage memory 53. The output pulse signal 74 is sent to the ASIC 51 of the controller 50. The CPU 52 has a computation processing function for executing various control programs of the image forming apparatus 200. The CPU 52 has a function of executing the control programs so that toner supply control for the developing device 100 is optimized based on the output pulse signal 74, print image data, and data information, for example, an environmental temperature.

Now, a function of measuring the output pulse signal 74 by the ASIC 51 is described. The ASIC 51 includes a first counter 55, a second counter 56, and a register 57. The first counter 55 is configured to count the output pulse signal 74 input to the ASIC 51 for a predetermined pulse number. The second counter 56 is configured to operate in synchronization with a clock of about 20 MHz so as to measure the time required for the first counter 55 to count the predetermined pulse number. The second counter 56 functions as a pulse measurement unit configured to measure a change in frequency of the output pulse signal 74 output from the toner concentration sensor 70 as a change in time. The register 57 is configured to store a measured value (measurement data) which is a count value counted by the second counter 56. The predetermined pulse number counted by the first counter 55 can be set in a variable manner. The predetermined pulse number is determined in advance in consideration of the frequency of the output pulse signal 74 of the toner concentration sensor 70, a configuration of the image forming apparatus 200, and a rotational speed of the agitation screws 82 and 83. In this embodiment, the predetermined pulse number counted by the first counter 55 is set to 5,000 pulses.

With the frequency of the output pulse signal 74 being about 1 MHz, it takes about 5,000 s to measure 5,000 pulses. The frequency (about 1 MHz) of the output pulse signal 74 changes depending on the toner concentration, and hence the time changes even for the same 5,000 pulses. When the change in time is measured by another counter, that is, the second counter 56, the toner concentration can be detected. When the second counter 56 counts with the 20 MHz clock, a measured value of about 100,000 {=5,000 μs÷(1÷20 MHz)} pulses results. More specifically, when the toner concentration increases from 7% to 8%, for example, the magnetic carrier in the developer is relatively reduced. Then, the frequency of the output pulse signal 74 of the toner concentration sensor 70 is reduced from 1 MHz to 0.99 MHz. The time required for the first counter 55 to measure 5,000 pulses is about 5,050 μs. The result measured with 20 MHz clock of the second counter 56 is about 101,010 pulses.

Next, a plurality of functions of the CPU 52 are described. The CPU 52 has a function of regularly reading out the measured value of the second counter 56 stored in the register 57 of the ASIC 51, and storing the measured value in a temporary storage memory 58 included in the CPU 52. The temporary storage memory 58 at least stores measured values corresponding to one period of the agitation screws 82 and 83. The CPU 52 has a computation function of calculating a maximum value, a minimum value, and an average value based on the measured values stored in the temporary storage memory 58. The CPU 52 has a function of calculating a measured value correction coefficient "α." The CPU 52 has a function of correcting the measured value with the use of the measured value correction coefficient "α."

The storage memory 53 is a non-volatile memory capable of holding stored data even when the image forming apparatus 200 is powered off. The storage memory 53 is capable of storing the average value of the measured values calculated in computation processing by the CPU 52, for example. In this embodiment, the CPU 52 stores, in the storage memory 53, an average value of measured values obtained in a development initialization mode executed when a new developing device 100 is mounted in the image forming apparatus 200. Operation in the development initialization mode is described later with reference to FIG. 8.

(Measured Value Correction Coefficient)

Figure 6:
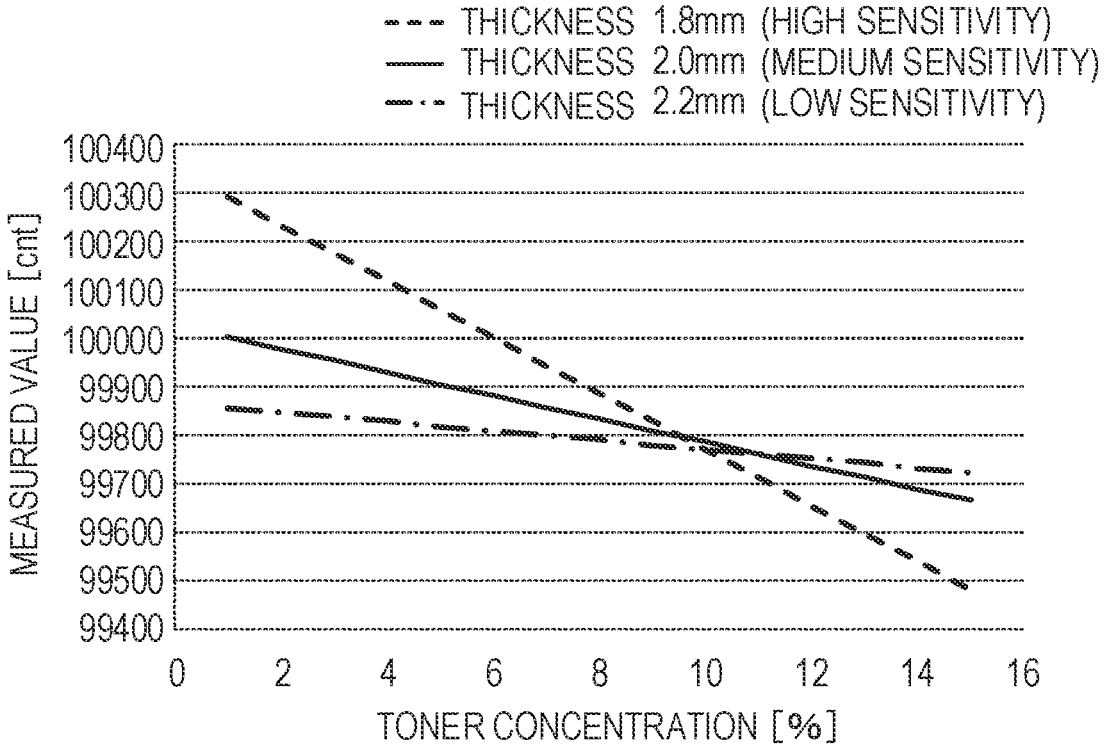
FIG. 6 is a graph for showing developer concentration detection characteristics for three developing devices having different container thicknesses.
Figure 7:
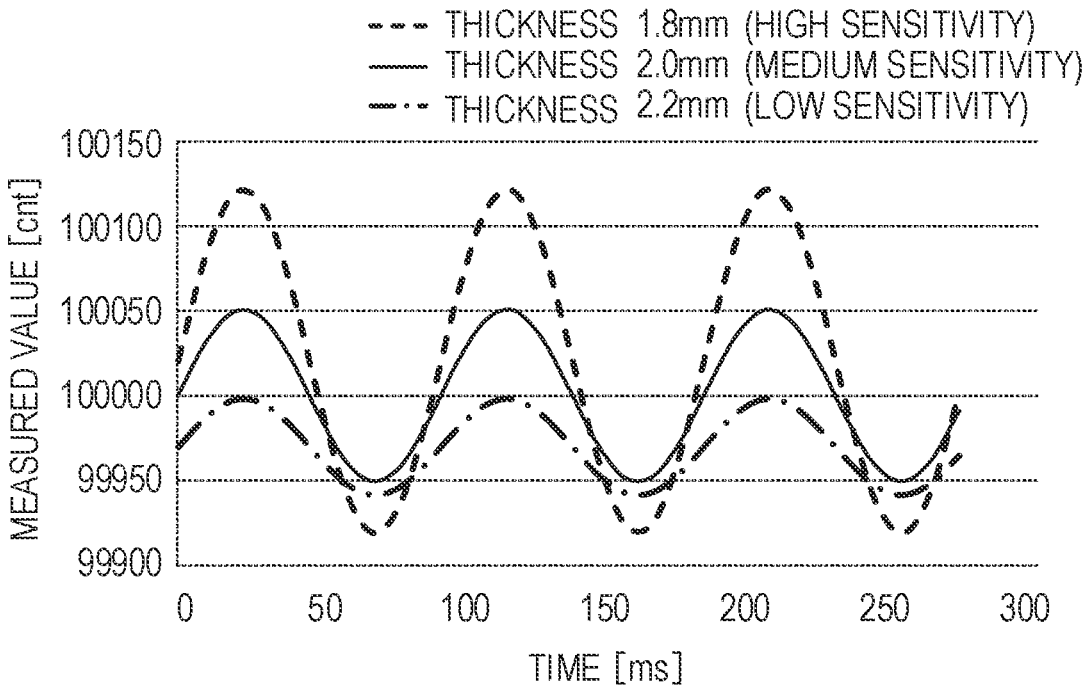
FIG. 7 is a graph for showing a measured value during a developer agitation operation for each container thickness.

Now, an expression for calculating the measured value correction coefficient "α" is described. In order to calculate the measured value correction coefficient "α," a concentration detection characteristic (FIG. 6) for each developing device 100 is identified. To that end, a theory for identifying the concentration detection characteristic is described. Three concentration detection characteristics shown in FIG. 6 indicate sensitivity characteristics having different slope sensitivities and offsets. The sensitivity characteristic is correlated with an amplitude variation amount which is shown in FIG. 7 and is obtained when the agitation screws 82 and 83 are operated. FIG. 7 is a graph for showing a measured value during a developer agitation operation for each container thickness. FIG. 7 shows measured values obtained when the agitation screws 82 and 83 are operated in time sequence.

When the agitation screws 82 and 83 are operated in a developing device 100 containing a developer having a toner concentration of 8%, a density of the developer varies by the agitation in a detection area of the toner concentration sensor 70. When a variation in measured value caused by the change in density of the developer is applied to a static characteristic graph of FIG. 6, the variation can be regarded as being equivalent to a toner concentration on the horizontal axis varying in a range of from 6% to 10%, for example. The range of from 6% to 10% of the toner concentration described here as an example is not limited thereto, because the range changes depending on a configuration of the agitation screws 82 and 83, the rotational speed (agitation speed), and characteristics of the developer. In this embodiment, when the variation caused by the agitation is assumed to be in the range of from 6% to 10% on the horizontal axis of FIG. 6, a change amount of the measured value shown on the vertical axis is different depending on a detection sensitivity characteristic shown for each container thickness of the developer container 81. In other words, when a variation amount of the measured value during the agitation operation is detected, the concentration detection characteristic of the developing device 100 can be identified.

An expression for calculating the measured value correction coefficient "α" is provided below.

$$\alpha = Y \div (\mathrm{MAX} - \mathrm{MIN}) \tag{1}$$

In the expression (1), MAX and MIN are data corresponding to the maximum value and the minimum value of the measured values during the agitation operation calculated by the computation function of the CPU 52. A difference between MAX and MIN is data corresponding to the amplitude variation amount of FIG. 7. A coefficient Y is a constant. In this embodiment, the coefficient Y is determined based on the amplitude variation amount of the developing device 100 having the container thickness of 2.0 mm as the reference characteristic of the concentration detection characteristics shown in FIG. 6. In this embodiment, the coefficient Y is determined to be a constant of 100 (Y=100). The coefficient Y is different depending on the characteristic of the toner concentration sensor 70, a configuration of the developing device 100, and the rotational speed of the agitation screws 82 and 83, and thus the coefficient Y is determined in advance for each product configuration. The coefficient Y is divided by the amplitude variation amount (maximum value-minimum value) to calculate the measured value correction coefficient "α".

A correction computing equation for correcting the measured value with the use of the measured value correction coefficient "α" is provided below.

$$\mathrm{CorrectDat} = (\mathrm{NowDat} - \mathrm{INIT_}DAT) \times \alpha \tag{2}$$

In the expression (2), INIT_DAT is data obtained in the development initialization mode and stored in the storage memory 53. NowDat is an average value calculated based on last measured values. The measured value correction coefficient "α" is calculated by the expression (1). Further, CorrectDat is a correction value (correction data). CorrectDat is a correction value corresponding to a deviation (change amount) in toner concentration from an initial toner concentration of 8% as a reference value. In this embodiment, each of INIT_DAT and NowDat is expressed by an average value. However, as long as the value is calculated from the measured values, each of INIT_DAT and NowDat may be the maximum value, the minimum value, or other computed value. INIT_DAT and NowDat may be any values as long as the values are derived based on the measured values by the same calculation method.

(Development Initialization Mode)

Figure 8:
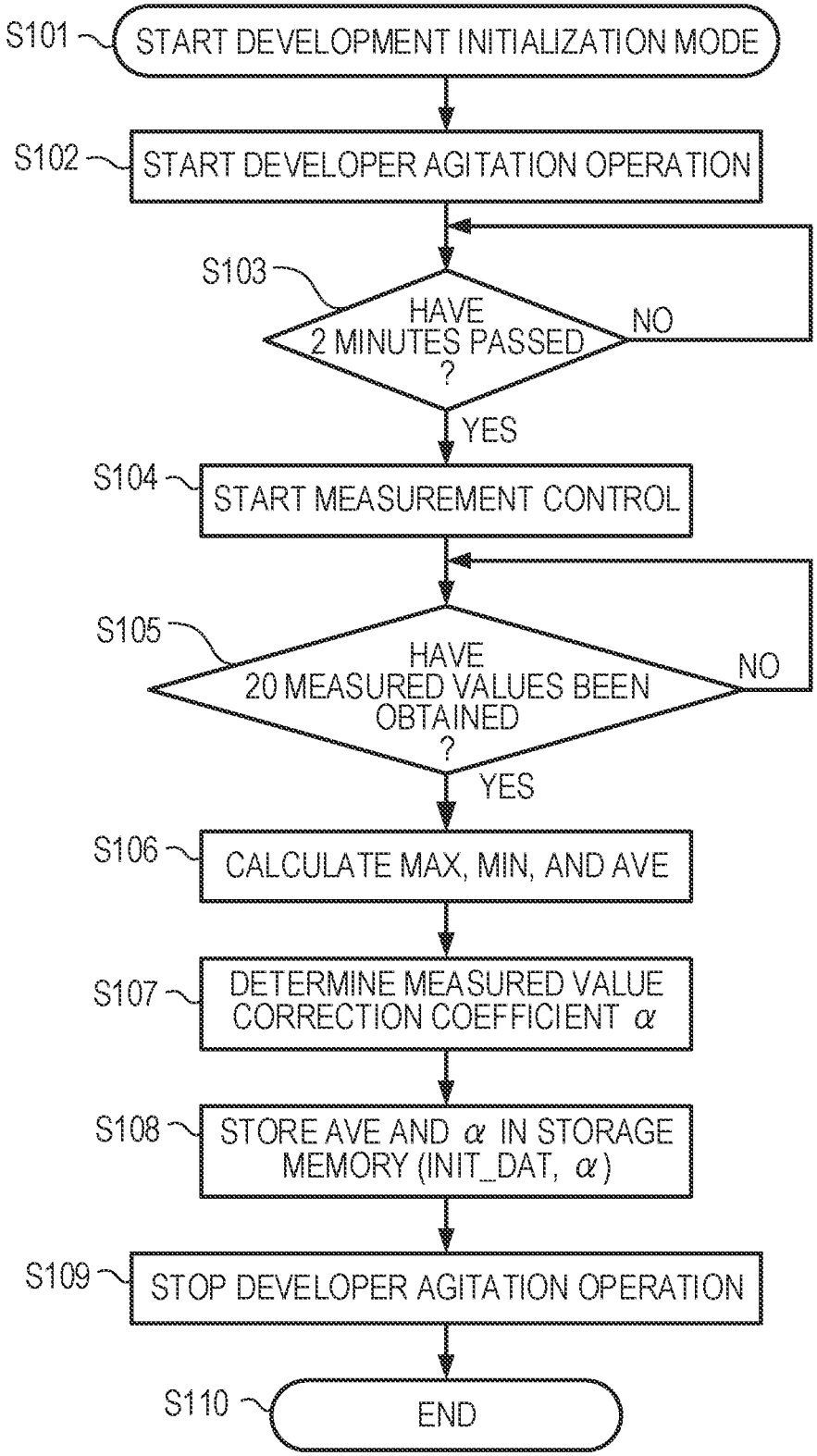
FIG. 8 is a flow chart for illustrating a control operation in a development initialization mode.

Next, referring to FIG. 8, the development initialization mode including a step of calculating the measured value correction coefficient "α" is described. FIG. 8 is a flow chart for illustrating a control operation in the development initialization mode. The controller 50 executes the control operation in the development initialization mode in accordance with a control program stored in the storage memory 53. The development initialization mode is executed when a new developing device 100 is mounted in the image forming apparatus 200. Here, a flow from the stage in which the development initialization mode is started (Step S101) is described. A similar flow is followed when any one of new developing devices 100*a*, 100*b*, 100*c*, and 100*d* is mounted in the image forming apparatus 200. In the description of FIG. 8, a case in which a developing device 100*a* corresponding to yellow is newly mounted in the image forming apparatus 200 is taken as an example for description. Description of a case in which a developing device 100*b*, 100*c*, or 100*d* corresponding to another color is newly mounted in the image forming apparatus 200 is omitted.

When the development initialization mode is started (Step S101), the controller 50 starts the developer agitation operation on the developing device 100*a* newly mounted in the image forming apparatus 200 (Step S102). In order to mix the two-component developer made of the toner and the magnetic carrier well, the agitation screws 82 and 83 are rotated for about 2 minutes to circulate the developer through the developer container 81. The CPU 52 determines whether 2 minutes have passed (Step S103). When the agitation operation for 2 minutes has finished (YES in Step S103), the controller 50 starts measurement control with the use of the toner concentration sensor 70 while executing the agitation operation (Step S104). When the measurement control is started, the ASIC 51 stores the measured value of the second counter 56 in the register 57 every time the output pulse signal 74 from the toner concentration sensor 70 is measured for 5,000 pulses (about 5 ms) by the first counter 55. In synchronization therewith, the CPU 52 reads out the measured value stored in the register 57 and stores the read measured value in the temporary storage memory 58 included in the CPU 52. The ASIC 51 repeats the sampling operation of measuring the measured value for every 5,000 pulses (about 5 ms).

The controller 50 determines whether 20 measured values have been obtained (Step S105). When the 20 measured values have been obtained (YES in Step S105), the CPU 52 calculates a maximum value MAX, a minimum value MIN, and an average value AVE based on the 20 measured values (Step S106). In this embodiment, the agitation screw 82 operates in a period of 100 ms, and hence the 20 measured values correspond to one rotation of the agitation operation. The predetermined number of sampled measured values is not limited to 20. For example, the predetermined number may be set to any number in accordance with the rotational speed of the agitation screw 82. The CPU 52 determines the measured value correction coefficient "α" in accordance with the expression (1) described above (Step S107). For example, when MAX=100,100, MIN=99,950, AVE=100,010, and Y=100, $\alpha=100\div(100{,}100-99{,}950)\approx0.667$. The average value AVE (=100,010) calculated in Step S106 and the measured value correction coefficient "α" (=0.667) determined in Step S107 are stored, in the storage memory 53, as characteristic values specific to the new developing device 100*a* (Step S108). The average value AVE calculated in Step S106 is stored as INIT_DAT in the storage memory 53. The controller 50 stops the developer agitation operation (Step S109), and ends the development initialization mode (Step S110).

(Print Job)

Figure 9:
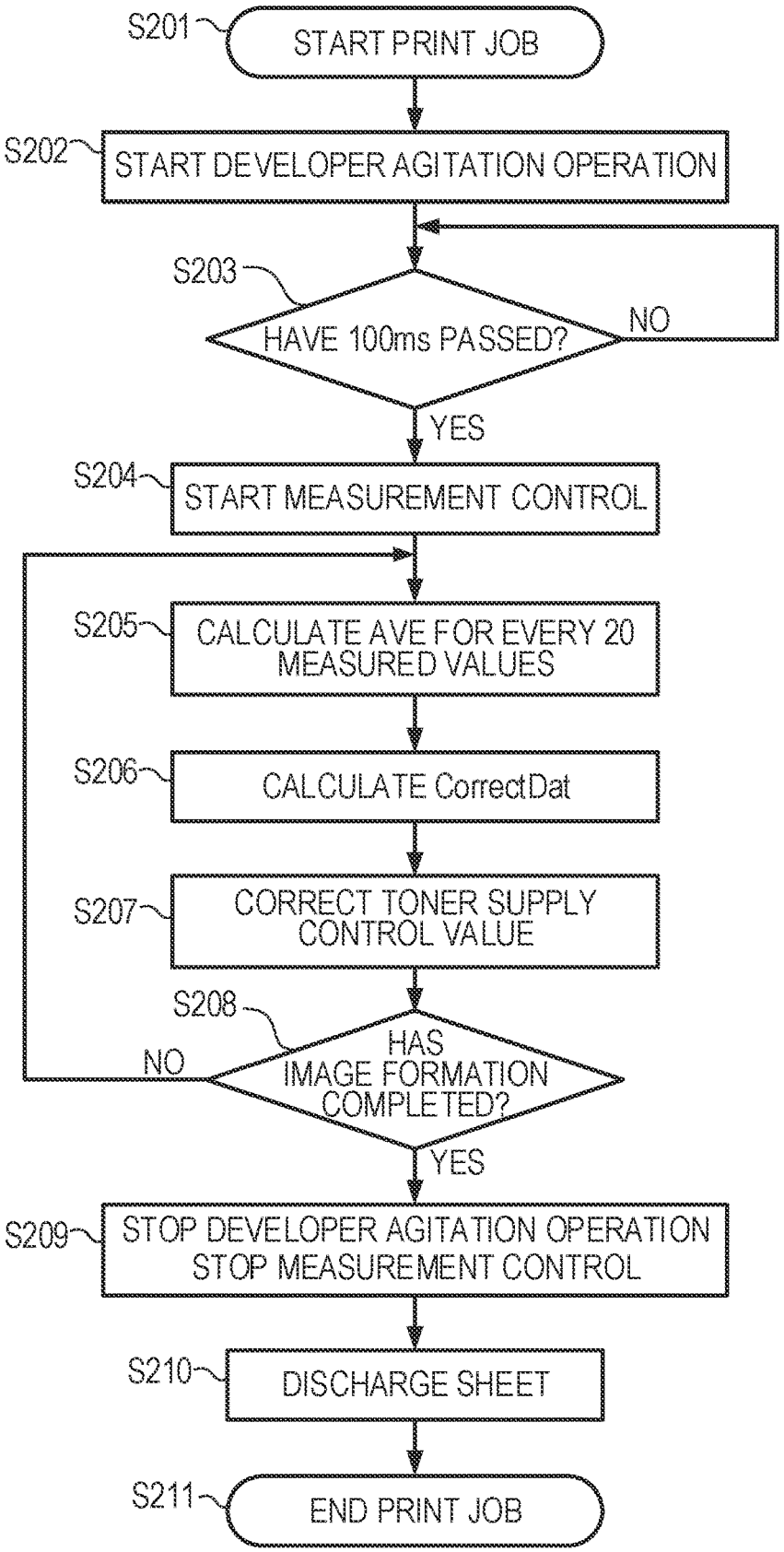
FIG. 9 is a flow chart for illustrating a print job operation.

Next, referring to FIG. 9, a print job operation including a step of correcting the measured value with the use of the measured value correction coefficient "α" calculated in the development initialization mode is described. FIG. 9 is a flow chart for illustrating the print job operation. The controller 50 executes the print job operation in accordance with a control program stored in the storage memory 53. FIG. 9 mainly shows the developer agitation operation and the measurement control by the toner concentration sensor 70, and an image forming process of the image forming apparatus 200 is omitted. As in the description of FIG. 8, control of the yellow developing device 100*a* is described here as an example, and description for other colors is omitted because a similar flow is followed.

A print job is started in accordance with a print job instruction from an operation display portion (not shown) of the image forming apparatus 200 or a computer connected to a network (Step S201). In order to agitate the two-component developer of the developing device 100*a*, the controller 50 starts the developer agitation operation in which the agitation screws 82 and 83 are operated (Step S202). In order to transition to the measurement control after the developer agitation operation is stabilized, in this embodiment, a waiting time Wait of 100 ms is set. The CPU 52 determines whether 100 ms have passed from the start of the developer agitation operation (Step S203).

When the waiting time Wait of 100 ms has passed (YES in Step S203), the controller 50 starts the measurement control with the use of the toner concentration sensor 70 while executing the agitation operation (Step S204). The controller 50 repeats the sampling operation of measuring the measured value based on the output pulse signal 74 from the toner concentration sensor 70 by the ASIC 51 and the CPU 52. Every time 20 measured values are obtained during image formation operation, the CPU 52 calculates the average value AVE of the 20 measured values (Step S205). The CPU 52 calculates the correction value CorrectDat in accordance with the expression (2) described above (Step S206). This is processing of correcting the measured value. When the average value AVE calculated in Step S205 is the average value AVE=100,050, and INIT_DAT and "α" stored in the storage memory 53 in the development initialization mode are INIT_DAT=100,010 and α=0.667, for example, the correction value CorrectDat is calculated as follows.

$$\text{Correction value CorrectDat}=(100{,}050-100{,}010)\times 0.667\approx 27$$

It is identified that the measured value of the developing device 100*a* has deviated from the initial value at the time of being mounted in the image forming apparatus 200 by 27.

When the frequency of the output pulse signal 74 of the toner concentration sensor 70 is reduced, the measured value deviates in a positive direction. When the measured value deviates in the positive direction, the toner concentration being the mixing ratio between the toner and the magnetic carrier has deviated to a lower value from the initial value of 8%. The toner concentration is expressed as: toner weight÷(toner weight+magnetic carrier weight), and thus when a numerical value of the toner concentration is reduced, it is determined that the amount of toner is small. Therefore, the controller 50 corrects a toner supply control value so as to increase a toner supply frequency at which the toner is supplied from the toner bottle Ta to the developing device 100*a* (Step S207). Toner supply control from the toner bottle Ta to the developing device 100*a* is control of supplying a predetermined amount of yellow toner from the toner bottle Ta to the developing device 100*a* when an integrated value of the yellow image data reaches a predetermined reference value. Therefore, the correction of the toner supply control value in Step S207 may be correction of the predetermined reference value with respect to the integrated value of the image data, or correction of the amount of the yellow toner supplied when the integrated value of the image data reaches the predetermined reference value.

The series of Step S205, Step S206, and Step S207 is repetitively continued until the image formation is completed. The CPU 52 determines whether the image formation has been completed (Step S208). When it is determined that the image formation has been completed (YES in Step S208), the controller 50 ends the developer agitation operation and the measurement control (Step S209). The controller 50 discharges the sheet having the image formed thereon from the image forming apparatus 200 (Step S210). The controller 50 ends the print job (Step S211).

According to this embodiment, the difference in concentration detection characteristic of the toner concentration sensor 70 caused by the variation in container thickness can be corrected. Therefore, the toner concentration in the developing device 100 is stabilized, and hue stability of the image forming apparatus 200 is increased.

According to this embodiment, the developer contained in the developing device 100 can be detected accurately by the toner concentration sensor 70.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-35061, filed Mar. 2, 2020, which is hereby incorporated by reference herein in its entirety.

What is claimed is:

1. An image forming apparatus comprising:

a photosensitive member;

a charging unit configured to charge the photosensitive member;

an exposure unit configured to expose the photosensitive member charged by the charging unit to form an electrostatic latent image on the photosensitive member;

a developing unit which includes a developing container configured to contain a developer including a toner and a carrier, and is configured to develop the electrostatic latent image by using the developer in the developing container;

a sensor which is provided on an outer wall of the developing container, and is configured to output a pulse signal of which a frequency is changed depending on a toner concentration of the developer in the developing container; and a controller configured to measure a time period in which a pulse number of the pulse signal output by the sensor reaches a predetermined pulse number, and control supply control of controlling an amount of the toner to be supplied to the developing unit based on the time period.

2. The image forming apparatus according to claim 1, wherein the sensor comprises an oscillation circuit including a resistor and a capacitor, and a pulse generation circuit configured to binarize a signal from the oscillation circuit to output the pulse signal.

3. The image forming apparatus according to claim 1, wherein the controller detects the toner concentration based on the time period and a correction coefficient, and controls the supply control based on the toner concentration.

4. The image forming apparatus according to claim 3, wherein the developing unit is removably mounted in the image forming apparatus, and wherein the correction coefficient is determined when a new developing unit is mounted in the image forming apparatus.

* * * * *